United States Patent [19]

Kim

[11] Patent Number: 5,050,741

[45] Date of Patent: Sep. 24, 1991

[54] CONTAINER WITH WIDE TEAR STRIP OPENING FEATURE

[76] Inventor: Myun H. Kim, 141 Meserole Ave. #2L, Brooklyn, N.Y. 11222

[21] Appl. No.: 558,307

[22] Filed: Jul. 25, 1990

Related U.S. Application Data

[63] Continuation-in-part of Ser. No. 947,806, Dec. 30, 1986.

[51] Int. Cl.[5] ..... B65D 3/26

[52] U.S. Cl. ..... 206/606; 206/615

[58] Field of Search ..... 206/605, 606, 608, 611, 206/612, 615, 630

[56] References Cited

U.S. PATENT DOCUMENTS

| | | | |
|---|---|---|---|
| 1,870,908 | 8/1932 | Hahn | 206/605 |
| 2,418,526 | 4/1947 | Reitman | 206/605 |
| 2,706,076 | 4/1955 | Guyer | 206/606 |
| 3,011,691 | 12/1961 | McGlynn et al. | 206/605 |
| 3,263,807 | 8/1966 | Fingerhut | 206/605 |
| 3,276,666 | 10/1966 | Johnson | 206/606 |
| 3,502,257 | 3/1970 | Virros | 206/606 |
| 3,539,093 | 11/1970 | Massengill | 206/606 |
| 3,951,333 | 4/1976 | Forbes, Jr. et al. | 206/611 X |
| 4,773,541 | 9/1988 | Riddell | 206/606 |

*Primary Examiner*—Bryon P. Gehman

*Attorney, Agent, or Firm*—Schweitzer Cornman & Gross

[57] ABSTRACT

A tear strip opening construction is disclosed, for providing a wide tear strip opening feature for corrugated cartons and other containers. A pair of spaced-apart tear band elements are mounted in parallel relation to the inside surface of the container wall, typically extending about the entire periphery of the container. A pair of cooperating guide strip elements are mounted on the outside surface of the container wall, arranged in parallel relation to the internal tear bands, with the respective inside edges of the guide strips being substantially aligned with the respective outside edges of the tear bands. Both the tear bands and the guide strips are formed of a relatively non-tearable material, such as plastic tape. A relatively wide strip of wall material is included between the inside edges of the guide strips. A reinforced gripping portion is provided at one end extremity of the container wall, extending substantially from one guide strip to the other. To open the container, the reinforced gripping portion is engaged by the hand and pulled outwardly, severing a wide strip of wall material defined between the respective guide strip portions.

9 Claims, 1 Drawing Sheet

CONTAINER WITH WIDE TEAR STRIP OPENING FEATURE

RELATED APPLICATIONS

This application is a continuation-in-part of my copending application Ser. No. 947,806, filed Dec. 30, 1986.

BACKGROUND AND SUMMARY OF THE INVENTION

The present invention relates to tear opening features for containers, especially (but not limited to) corrugated cartons of the type, for example, used for shipment of canned or bottled goods. In particular, the invention is directed to a tear opening feature for a sealed carton having top and bottom walls and side walls, where opening of the container can be accomplished by removing a relatively wide strip of the container side wall, around its entire periphery. This enables complete separation of the top and bottom portions of the container, leaving the contents exposed in the truncated lower portion of the container, which includes a portion of the circumscribing side wall.

In accordance with the invention, a container is constructed to provide a pair of widely spaced tear bands, formed of relatively non-tearable material, secured in parallel relation to the inside surface of the container side wall, along the entire length of the wall portion to be opened, typically around the entire periphery. On the outside surface of the container there are provided a pair of widely spaced-apart guide strip elements, also arranged in parallel relation. The guide strip elements are aligned so that their respective inner edges are substantially aligned with the respective outer edges of the internal tear bands. The guide strips define between them a relatively wide section of container wall, which forms the wide tear strip portion.

At one end of the wall, a reinforced grip portion is provided, which is effectively attached to the spaced internal tear band elements. When the grip portion is engaged and pulled outwardly, the respective spaced-apart tear bands are simultaneously drawn outward, with a cutting/tearing action against the inner edges of the guide strips, causing a wide strip-like section of the wall to be torn away.

In a particularly preferred form of the invention, the tear band structure extends entirely about the periphery of the carton, so that upon completion of removal of the tear strip section, the upper portion of the container is entirely separated from the lower portion and can be lifted away to expose the contents of the container.

For a more complete understanding of the above and other features and advantages of the invention, reference should be made to the following detailed description of a preferred embodiment of the invention, and to the accompanying drawings.

DESCRIPTION OF PREFERRED EMBODIMENT

Figure 1:
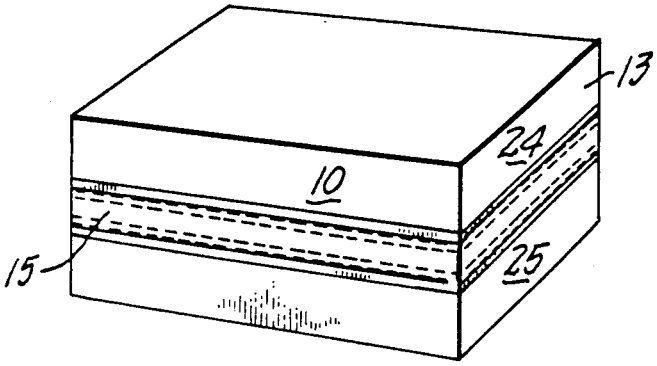
FIG. 1 is a perspective view of a typical carton, formed of corrugated board or the like, provided with a wide tear strip opening feature according to the invention.

Referring now to the drawing, the reference numeral 10 designates generally a container, which may be of a variety of configurations and constructed of a variety of materials. In a typical and advantageous construction, the container 10 is of rectangular configuration and is constructed corrugated board material. The illustrated container is formed with a top wall 11, a complementary bottom wall (not shown) and four side walls, of which an end wall 12 and a side wall 13 are illustrated, circumscribing the container. A short glue lap 14, hinged to the free end of the side wall 13, underlies and is adhesively secured to the free end of the adjacent end wall 12. This is in accordance with conventional container construction.

In accordance with the invention, a wide tear strip section 15, circumscribing the entire container is defined by a pair of widely spaced guide strip elements 16, 17, which are secured in parallel relation to the outer surfaces of the container end and side walls. The guide strip elements 16, 17 are formed of a relatively non-tearable material. Among materials well suited for this purpose are plastic tapes, such as tapes formed of polyvinyl chloride, for example. Other materials suitable for the purpose are tapes of metal foil, tapes formed of plastic materials reinforced with fiberglass strings, beads of hot melt material, and the like.

Figure 4:
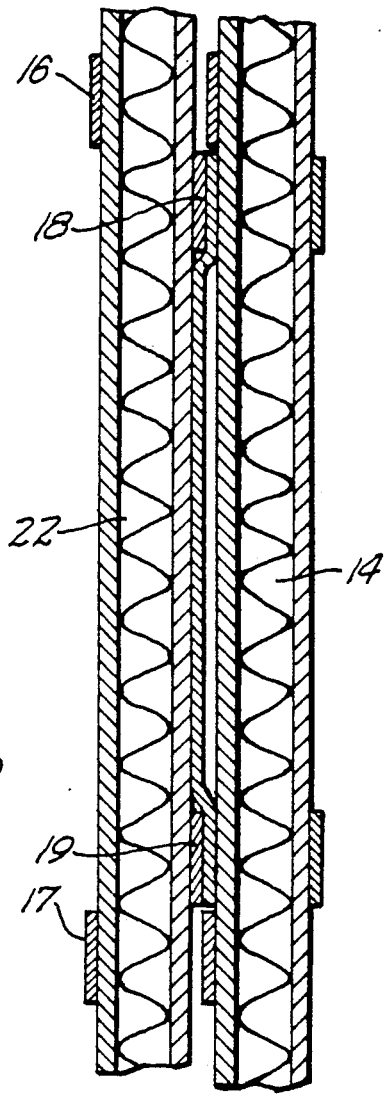
FIGS. 3 and 4 are enlarged, fragmentary cross sectional views as taken generally on lines 3—3, 4—4 respectively of FIG. 2.
Figure 3:
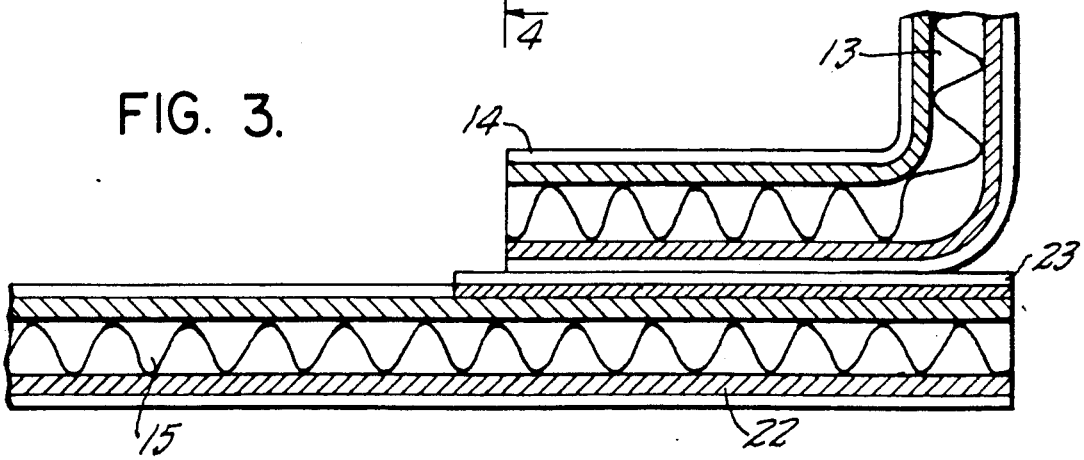

A cooperating pair of spaced-apart upper and lower tear band elements 18, 19 are mounted to the inside surface of the container end and side walls, extending parallel to and coextensive with the external guide strips 16, 17. The lower edge of the upper guide strip 16 and the upper edge of the upper tear band 18 are substantially aligned and constitute a first pair of cooperating cutting edges 16*a*, 18*a*. Likewise, the upper edge of the lower guide strip 17 and the lower edge of the lower tear band 19 are substantially aligned and constitute a second pair of cooperating cutting edges 17*a*, 19*a*. As is reflected in FIG. 3, the internal tear bands 18, 19 and the external guide strips 16, 17 are also provided over the short length of the glue lap 14, so that, in the area of overlap between the free end of the end wall 12 and the glue lap 14, there are duplicate sets of tear bands and guide strips. This is shown in FIGS. 3 and 4.

Figure 2:
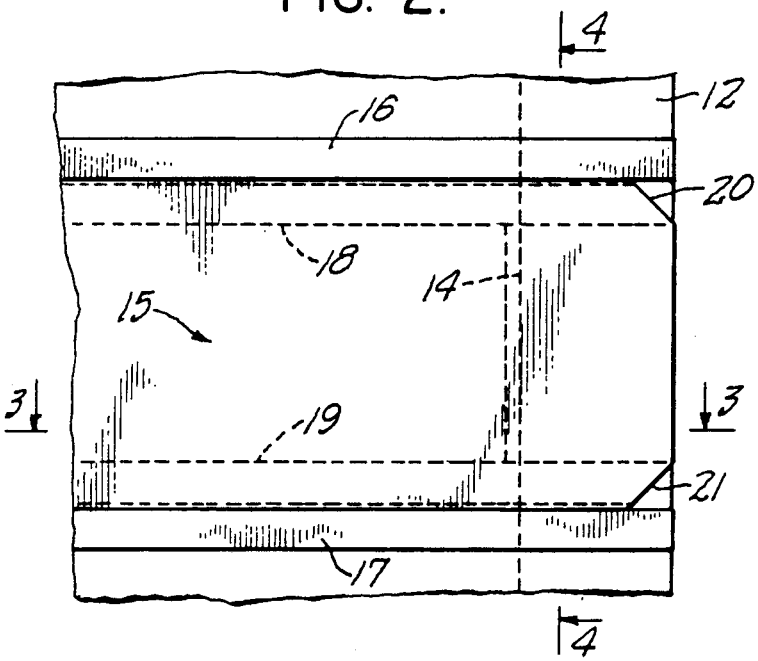
FIG. 2 is an enlarged, fragmentary view of a portion of the tear strip opening feature, showing particularly the reinforced gripping portion.

To particular advantage, the tear strip section 15 is notched out at its end extremity, as indicated at 20, 21 in FIG. 2, to help define the start of the tear strip and facilitate initial tearing along the proper line, as well as to facilitate initial gripping of the free end of the tear band. Additionally, a gripping portion 22 is defined at the free end of the tear band 15 by means of a suitable reinforcing material 23, typically plastic tape, which extends from one internal tear band to the other, as shown in FIGS. 3 and 4.

In the construction of the container 10, the free end margin of the container wall end 12 can be secured to the glue lap 14 by conventional means, such as staples (not shown) or by a suitable adhesive. Where adhesive is employed, the reinforcing material 23 is formed of a plastic, such as polypropylene, having limited adhesion with the adhesive material employed. Accordingly, the reinforced gripping portion 22 of the tear strip is accessible to be lifted by the fingers and gripped, and the tear strip portion can be torn free, even in the area of the glue lap.

To open the container of FIG. 1, the reinforced end portion 22 of the tear strip is gripped and pulled outwardly in a continuous motion, extending entirely about the periphery of the container, first along the end wall portion 12, then along the adjacent side wall and back end wall portions (not visible in FIG. 1) and finally along the side wall 13. Upon reaching the free end of the side wall 13, continued pulling on the tear strip causes the tearing to continue along the length of the glue lap 14, until the tear strip is entirely freed from the container, completely separating the upper portion 24 from the lower portion 25. The upper portion 24 of the container can then be simply lifted away, exposing the contents of the container, while the contents remain partially confined in the remaining bottom portion 25 of the container.

In a typical embodiment of the invention, the container 10 might be constructed to provide a tear strip section of, for example, three to four inches in width, defined by the distance between the respective pairs of cutting edges 16*a*, 18*a* and 17*a*, 19*a*. This is a convenient size to enable a full hand grip to be applied to the reinforced end portion 22 of the tear strip section, so that the container material can be readily torn along the spaced tear lines. If desired, the container may be weakened somewhat in the area of the guide strips and tear bands, as by the use of lines of spaced-apart perforations or other lines of weakness (not shown), to reduce the force required in tearing away the strip section 15.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A tear-open construction for a container having an openable wall, which comprises (a) a pair of spaced-apart upper and lower internal tear bands arranged in parallel relation and secured to the interior surface of said openable wall, (b) the upper edge of the upper tear band and the lower edge of the lower tear band constituting spaced-apart cutting edges, (c) said internal tear bands defining between their respective cutting edges a tear strip portion of said openable wall, (d) said tear strip portion being substantially wider than said tear bands, (e) a pair of spaced-apart upper and lower guide strip elements secured to the exterior surface of said openable wall in parallel relation to said internal tear bands, (f) the lower edge of the upper guide strip element and the upper edge of said lower guide strip element constituting spaced-apart cutting edges, (g) the cutting edges of said guide strip elements being generally aligned with the cutting edges of said internal tear bands, (h) the tear strip portion of said openable wall having at one end extremity thereof a reinforced grip portion extending vertically between and structurally joining said tear bands and thereby enabling said tear bands and said tear strip portion to be gripped and pulled away as a unit from said openable wall, (i) said reinforced grip portion being relatively free of attachment to any underlying portions of the container, whereby said grip portion is accessible to be lifted by the fingers and gripped for removal of said tear strip portion.

2. A construction according to claim 1, further characterized by, (a) said container being a closed container having top and bottom walls and circumscribing side walls, and (b) said tear bands, said guide strip elements and said tear strip portion extending about the entire periphery of said container, to enable complete separation of top and bottom portions of said container.

3. A construction according to claim 1, further characterized by (a) said grip portion being reinforced with non-tearable material extending vertically between and structurally joining said tear bands.

4. A construction according to claim 1, further characterized by (a) said tear bands and said guide strip elements being formed of plastic tape, metal foil, or beads of hot melt plastic material.

5. A construction according to claim 1, further characterized by (a) the openable wall of said container comprising container end walls and container side walls, (b) a free end portion of one of said walls having joined hereto a glue lap portion underlapping and secured to a free end portion of an adjacent one of said walls, (c) the portion of said openable wall comprising said tear strip portion being substantially free of attachment to said glue lap portion.

6. A construction according to claim 5, further characterized by (a) said glue lap being adhesively secured to the free end portion of said adjacent one of said walls, (b) said grip portion having a plastic reinforcing material on the surface thereof confronting said glue lap, (c) said plastic material having limited adhesion with said glue lap to accommodate pulling away of said grip portion for opening of said container.

7. A construction according to claim 5, further characterized by (a) said guide strip elements and said tear bands extending across the outer and inner surfaces respectively of said glue lap.

8. A tear-open construction for a container having an openable wall, which comprises (a) a pair of spaced-apart upper and lower internal tear bands arranged in parallel relation and secured to the interior surface of said openable wall, (b) the upper edge of the upper tear band and the lower edge of the lower tear band constituting spaced-apart cutting edges, (c) said internal tear bands defining between their respective cutting edges a tear strip portion of said openable wall, (d) said tear strip portion being substantially wider than said tear bands, (e) guide strip means, for guiding the tear strip portion, secured to the exterior surface of said openable wall in parallel relation to said internal tear bands and having portions above the upper tear band and portions below the lower tear band, (f) said guide strip means having portions forming upper and lower guide strip cutting edges generally aligned with and cooperating with the spaced-apart cutting edges of said tear bands and, (g) the tear strip portion of said openable wall having at one end extremity thereof a grip portion extending vertically between and structurally joining said tear bands and thereby enabling said tear bands and said tear strip portion to be gripped and pulled away as a unit from said openable wall, (h) said grip portion being relatively free of attachment to any underlying portions of the container, whereby said grip portion is accesible at an end extremity thereof to be lifted by the fingers and gripped for removal of said tear strip portion, (i) said grip portion being formed with notches at said end extremity, at vertically spaced points immediately adjacent said guide strip means to facilitate initial tearing of said tear strip portion along said cutting edges, (j) the end extremity of said grip portion being of continuous construction between said cutting edges whereby said spaced apart tear bands are simultaneously pulled away along with said grip portion, (k) said tear bands being coterminous at their free ends with said grip portion, such that no free portions of said tear bands extend beyond the end extremity of said grip portion and said tear bands are accessible only by pulling on said grip portion.

9. A construction according to claim 8, further characterized by (a) means for reinforcing said grip portion extending vertically between said tear bands.

* * * * *